US007380664B2

(12) United States Patent
Suzuki

(10) Patent No.: US 7,380,664 B2
(45) Date of Patent: Jun. 3, 2008

(54) PACKAGING BAGS AND DISPLAY RACKS AND METHODS FOR DISPLAYING THE PACKAGING BAGS

(75) Inventor: Kengo Suzuki, Aichi-ken (JP)

(73) Assignee: Yahata Neji Co., Ltd., Aichi-ken (JP)

( * ) Notice: Subject to any disclaimer, the term of this patent is extended or adjusted under 35 U.S.C. 154(b) by 512 days.

(21) Appl. No.: 11/213,793

(22) Filed: Aug. 30, 2005

(65) Prior Publication Data

US 2006/0043037 A1 Mar. 2, 2006

(30) Foreign Application Priority Data

Aug. 30, 2004 (JP) ..... 2004-250184

(51) Int. Cl.
*B65D 73/00* (2006.01)

(52) U.S. Cl. ..... 206/466; 206/459.5; 211/50; 211/85.15

(58) Field of Classification Search ..... 206/466, 206/459.5, 806, 461, 338; 383/13, 22, 23, 383/200, 207; 211/85.15, 50
See application file for complete search history.

(56) References Cited

U.S. PATENT DOCUMENTS 2,983,087 A * 5/1961 Schofield ..... 53/410
3,014,638 A * 12/1961 Farley ..... 206/459.5
3,385,506 A * 5/1968 Ryburn ..... 206/459.5
3,395,792 A * 8/1968 Larson ..... 206/459.5
3,863,837 A * 2/1975 Spiegel et al. ..... 229/87.04
3,910,412 A * 10/1975 Vargo ..... 206/459.5
4,724,964 A * 2/1988 Hernandez ..... 206/461
4,764,028 A * 8/1988 Wood et al. ..... 383/20
5,344,027 A * 9/1994 Kaplan ..... 211/1
5,390,796 A * 2/1995 Kerfoot, Jr. ..... 206/534
5,445,272 A * 8/1995 Crisp ..... 206/459.5
2001/0042727 A1* 11/2001 Riga ..... 211/189

FOREIGN PATENT DOCUMENTS

JP 09-034367 2/1997

* cited by examiner

*Primary Examiner*—David T Fidei
(74) *Attorney, Agent, or Firm*—Dennison, Schultz & MacDonald

(57) ABSTRACT

A packaging bag for containing products has a bag body and a display member attached to the bag body in order to close the opening of the bag body. The display member has a front portion on one side of the bag body and a back portion on the other side of the bag body. The front portion of the display member has a first region colored with a first color and a second region colored with a second color. The first color and the second color are respectively indicative of a type of product and a standard of product. The display member has a tearable line so that the display member can be torn along the tearable line in order to enable access to the products within the bag body via the opening. The front portion may remain on the bag body after opening the packaging bag.

17 Claims, 6 Drawing Sheets

PACKAGING BAGS AND DISPLAY RACKS AND METHODS FOR DISPLAYING THE PACKAGING BAGS

This application claims priority to Japanese patent application serial number 2004-250184, the contents of which are incorporated herein by reference.

BACKGROUND OF THE INVENTION

1. Field of the Invention

The present invention relates to packaging bags. The present invention also relates to display racks and methods for displaying the packaging bags.

2. Description of the Related Art

A known packaging bag 100 for containing fasteners, such as screws 108, is shown in FIG. 8. The packaging bag 100 has a bag body 104 with an opening 104*a*. Welding a tubular film at a peripheral portion except for the opening 104*a* may form the bag body 104. A display member 102 is made of a flat sheet material and has a surface on which product information is printed, such as reference size information 103. In addition, the surface of the display member 102 is colored with a color that may indicate that the contained products are screws 108. The display member 102 is folded in order to cover the opening 104*a* of the bag body 104. The display member 102 and the bag body 104 are then joined together by staples 106, so that the opening 104*a* can be sealingly closed. A customer can easily distinguish the packaging bag 100 from those containing fasteners other than screws 108 because the display member 102 is colored with a specific color. Such a known packaging bag is disclosed in Japanese Laid-Open Patent Publication No. 9-034367, for example.

However, after the display member 102 has been removed in order to unseal the bag body 104, the customer may loose the product information. Typically, from the point of opening forward the display member 102 is no longer used and is therefore discarded.

In addition, the screws 108 may be used in combination with compatible nuts that are threadably engageable with the screws 108. The nuts may be sold separately from the screws 108. Although the display member 102 enables the screws 108 to be distinguished from other kinds of fasteners, the display member 102 is not configured to enable a purchaser to easily find nuts compatible with the screws 108.

SUMMARY OF THE INVENTION

It is accordingly an object of the present invention to teach improved techniques for enabling easy identification of products contained in a packaging bag.

In one aspect of the present teachings, packaging bags for containing products are taught. The products may be fasteners such as screws, bolts, nuts, pins, and nails, fastener related parts such as washers, machine or architectural parts such as chains and wires, or materials such as pipes, bars, and plates. The packaging bags include a bag body and a display member. The display member is attached to the bag body in order to close an opening formed in the bag body. The display member has a front portion on one side of the bag body and a back portion on the other side of the bag body. The front portion of the display member has a first region colored with a first color and a second region colored with a second color. The first color and the second color respectively indicate a type of product and a standard, such as a reference size, a configuration, and a material, of the products in the packaging bag. The display member has a tearable line. The display member can be torn along the tearable line in order to enable access via the opening to the products contained within the bag body.

Because the first and second regions of the display member are respectively colored with a first color and a second color indicative of the type and the standard of the products, the distributor or the customer can readily obtain information concerning the products from the display member and can readily identify the products contained within the packaging bag.

In addition, because the display member can be torn along the tearable line in order to enable access to the products within the bag body via the opening, the customer can still obtain the product information from the first and second regions provided on the front portion, which may remain attached to the bag body even after the packaging bag has been opened.

In one embodiment, the front portion further includes a first pattern and a second pattern formed thereon and respectively indicative of the type of the products and the standard of the products. The first pattern may be characters indicative of a reference size of the products. The second pattern may be a pictorial image of the products. The second color may be indicative of the configuration of a particular part of the product, such as the head type of a screw.

Preferably, the display member is a sheet folded so as to define a front portion and a back portion. The front portion and the back portion of the display member are respectively bonded to the bag body, while the back portion may be peeled off of the bag body. Therefore, the display member may be torn along the tearable line so that the display member is separated into a first part, on the side of the front portion, and a second part on the side of the back portion. The second part may be removed from the display member by peeling off the back portion from the bag body.

In another embodiment, the front portion further includes a third pattern indicative of a price of the products. For example, the third pattern may be at least one dot, indicative of a reference value of the price.

In a second aspect of the present teachings, display racks are taught for use in combination with the packaging bags. The display racks may have a generic information display device that includes a third region and a fourth region respectively colored with the first color and the second color.

Therefore, the customer can also obtain information of the products from the generic information display device and can readily identify the products containing the packaging bags with reference to the third region and the fourth region of the generic information display device.

In one embodiment, the display device further includes a printed image of the products.

In another embodiment, the display rack is used in combination with a plurality of the packaging bags including at least a first and a second group of packaging bags respectively containing first products and second products that are the same in type but have different configurations from each other. In such a case, the display device has a single third region colored with the first region color and at least two fourth regions colored with the appropriate second region colors respectively corresponding to the first and second groups of packages.

Therefore, the customer can distinguish between the first and second groups of the packaging bags with reference to the second colors of the second regions of their display members. It is also possible to obtain product information from the generic information display device. A customer can readily identify the products containing the first and second groups of packaging bags with reference to the third region and the fourth regions of the generic information display device.

In one embodiment, the display rack further includes a display panel having a plurality of hooks mounted thereon. The hooks include at least a first and a second group of hooks respectively corresponding to the first and second groups of packaging bags. The hooks may be positioned to respectively correspond to the fourth regions of the display device.

In another embodiment, the display device has a pair of side panels extending substantially perpendicular to the display panel, so that a compartment or section for displaying the packaging bags is defined by the pair of side panels and the display panel.

In a second aspect of the present teachings, methods of displaying at least one packaging bag are taught. The methods include the step of providing a display rack having a generic information display device and the display panel. The methods further include the step of engaging at least one packaging bag with at least one hook of the display panel in such a manner that the packaging bag hangs down from the hook with the front portion of the display member of the display device visually recognizable.

Therefore, the packaging bag(s) can be reliably engaged by the corresponding hook with reference to the second information of the packaging bag and the second information of the display device. In addition, the customer can readily identify the products contained within the packaging bag(s) from the product information, which is included on the front portion of the packaging bag(s), during the display on the display rack.

DETAILED DESCRIPTION OF THE INVENTION

Each of the additional features and teachings disclosed above and below may be utilized separately or in conjunction with other features and teachings to provide improved packaging bags, display racks for displaying such packaging bags, and methods of displaying the packaging bags. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative embodiment will now be described with reference to FIGS. 1 to 7. In these figures, hatching is used to represent a color. In addition, different hatchings are used to represent different colors. Therefore, the regions with different hatching are colored with different shades of colors.

Representative Display Device

Figure 1:
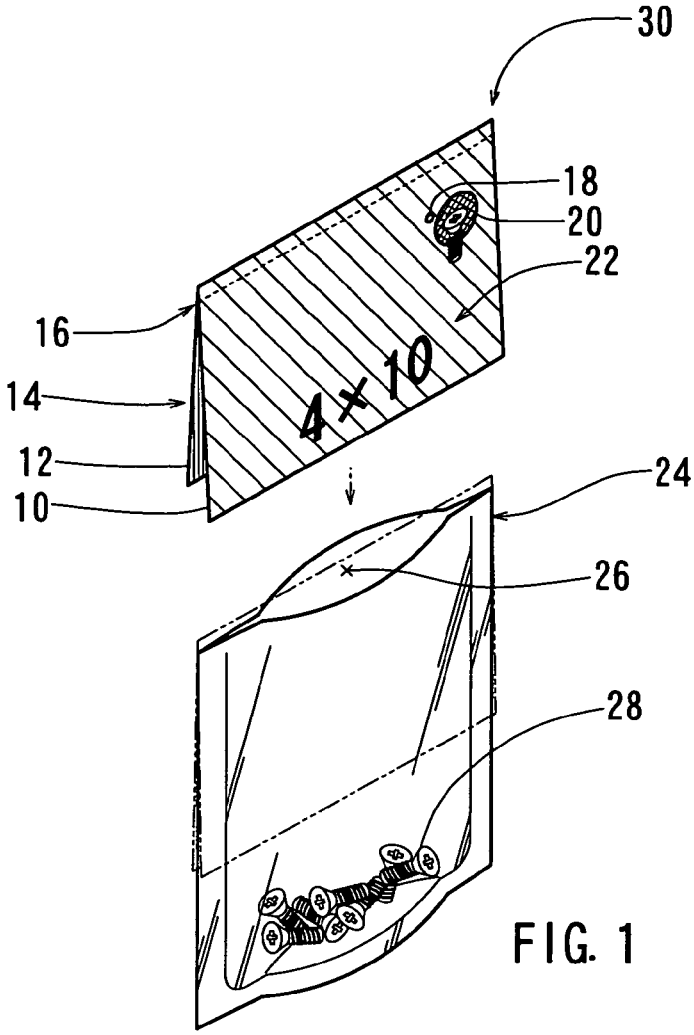
FIG. 1 is an exploded perspective view of a representative packaging bag.

A representative display member 14 will now be described with reference to FIGS. 1 to 3. The representative display member 14 is used in combination with a bag body 24 in order to form a packaging bag 30. The bag body 24 has an opening 26 and may be formed by a flat tubular film that is welded around a peripheral portion, except for a portion corresponding to the opening 26. Screws 28 are shown as being placed within the bag body 24.

The display member 14 is made of a flat sheet-like member and is folded to cover the opening 26 of the bag body 24. The display member 14 has a front portion 10 and a back portion 12 that are positioned on a front side and a backside as shown in FIGS. 1 and 3. The tearable line 16, which will be explained later, substantially delimits the front portion 10 and the back portion 12.

The front portion 10 and the rear portion 12 are respectively bonded to the front surface and the back surface of the bag body 24 by adhesive. At least the rear portion 12 may be removably adhered to bag body 24, allowing at least the rear portion to be peeled away from the bag body 24. After the display member 14 has thus been bonded to the bag body 24, a through hole 17 may be formed in an upper portion of the packaging bag 30 so as to extend though the upper portions of the display member 14 and the bag body 24. Although it is understood that the location of the hole 17 is not limited to just this embodiment, for example, the hole 17 may be located above the bag body 24 and the tearable line 16 so as to allow the performing of the hole 17 in the display member 14 prior to assembly with the bag body 24. The through hole 17 may be used for inserting a hook member 54 shown in FIGS. 4 and 5 as will be explained later.

Figure 2:
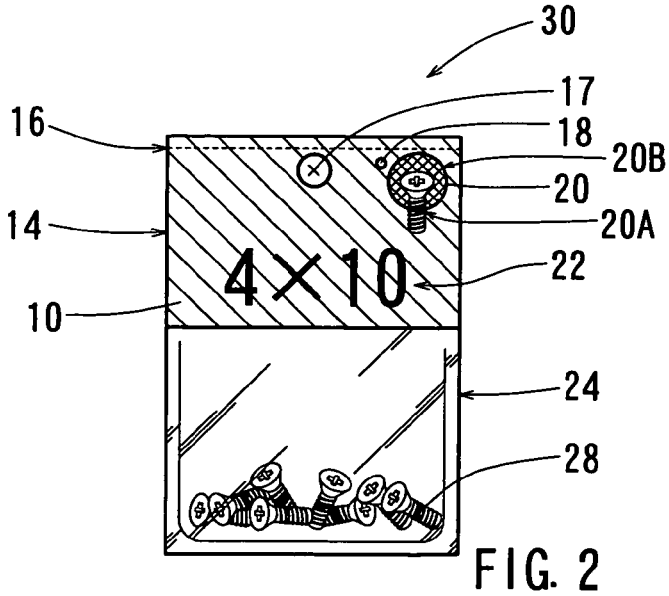
FIG. 2 is a front view of the packaging bag.
Figure 3:
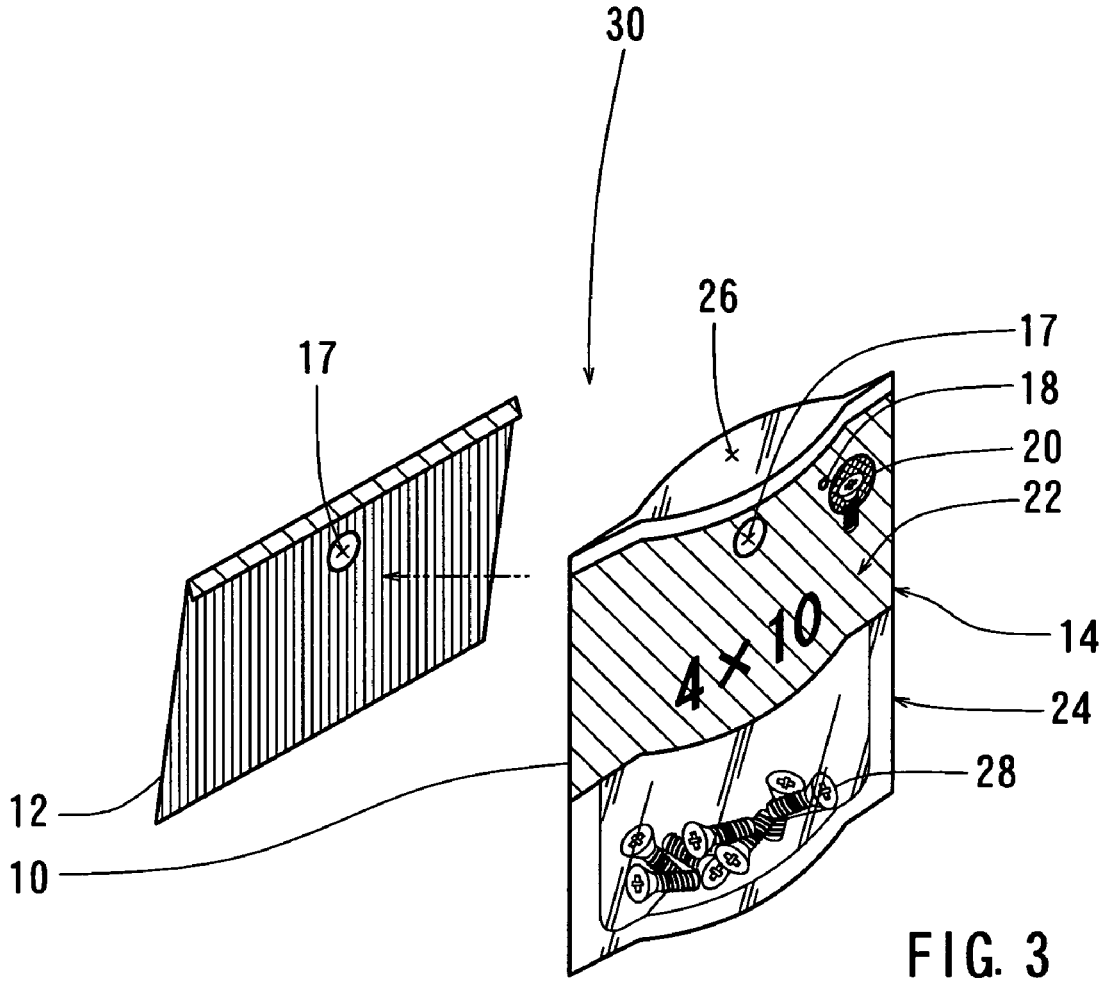
FIG. 3 is a perspective view of the packaging bag showing the state where a display member is removed in order to open a bag body.

In this representative embodiment, the tearable line 16 (e.g., a perforated line) may be formed proximate to the upper edge of the front portion 10 and extends linearly in a right and left direction as viewed in FIG. 2. By removing the back portion 12 along the tearable line 16 from the bag body 24, it is possible to open the packaging bag 30 as shown in FIG. 3.

The surface of the front portion 10 may have a first color that is designated to correspond to a particular type of fasteners (e.g., such as screws in this representative embodiment). The front portion 10 will hereinafter also be called the "first standard information display region." In addition, various product information related to the screws 28 is printed on the surface of the front portion 10. This product information may include a first information set 22, second information set 20, and third information set 18. The first information set 22 may be the reference size (e.g., "4×10") of the screws 28. The second information set 20 may include a printed image 20A of the screw 28 and a circular region 20B surrounding the head of the screw 28 in the printed image 20A. The circular region 20B may have a second color that is a different shade of color from the first color and corresponds to the configuration of the head of the screw 28. The circular region 20B will hereinafter also be called the "second standard information display region." The third information set 18 may be a printed symbol such as a dot or dots indicative of the price of the screws 28.

As described above, the surface of the front portion 10 (the first standard display region) of the packaging bag 30 may have a first color indicative of the type of fastener. In addition, the circular region 20B (the second standard display region) surrounding the head of the printed image 20A of the screw 28 may have a second color that is a different shade of color than the first and is indicative of the configuration of the head of the screw 28. Therefore, the customer can readily identify the basic product information of the screw 28. In addition, the customer can readily distinguish the packaging bags 30 containing the screws 28 from other packaging bags 30 that may contain a different type of fasteners or that may contain screws with a different head configuration than the head of the screw 28.

In particular, the circular region 20B, with a distinctive second color, is printed on the display member 14 together with the printed image 20A of the screw 28. Therefore, the customer can further readily reliably distinguish the packaging bag 30 containing the screw 28 from those containing different types of screws.

Further, the third information set 18, e.g. symbols or the printed dot or dots, is indicative of the price of the screws 28. For example, one dot may correspond to a predetermined amount such as $1.00. Therefore, even if the price of the screws 28 contained in the packaging bag 30 is to be changed, it is not necessary to rewrite the price on each of the packaging bags 30. It is only necessary for the retailer to change the predetermined amount corresponding to the dot.

Furthermore, the back portion 12 of the display member 14 may be torn off from the front portion 10 along the tearable line 16 in order to open the packaging bag 30 or to enable access to the screws 28 through the opening 26. The front portion 10 may still remain bonded to the packaging bag 30 even after the packaging bag 30 has been opened. As a result, the customer can continue to access the first to third information sets 22, 20, and 18, from the display member 14.

Representative Display Rack

Figure 4:
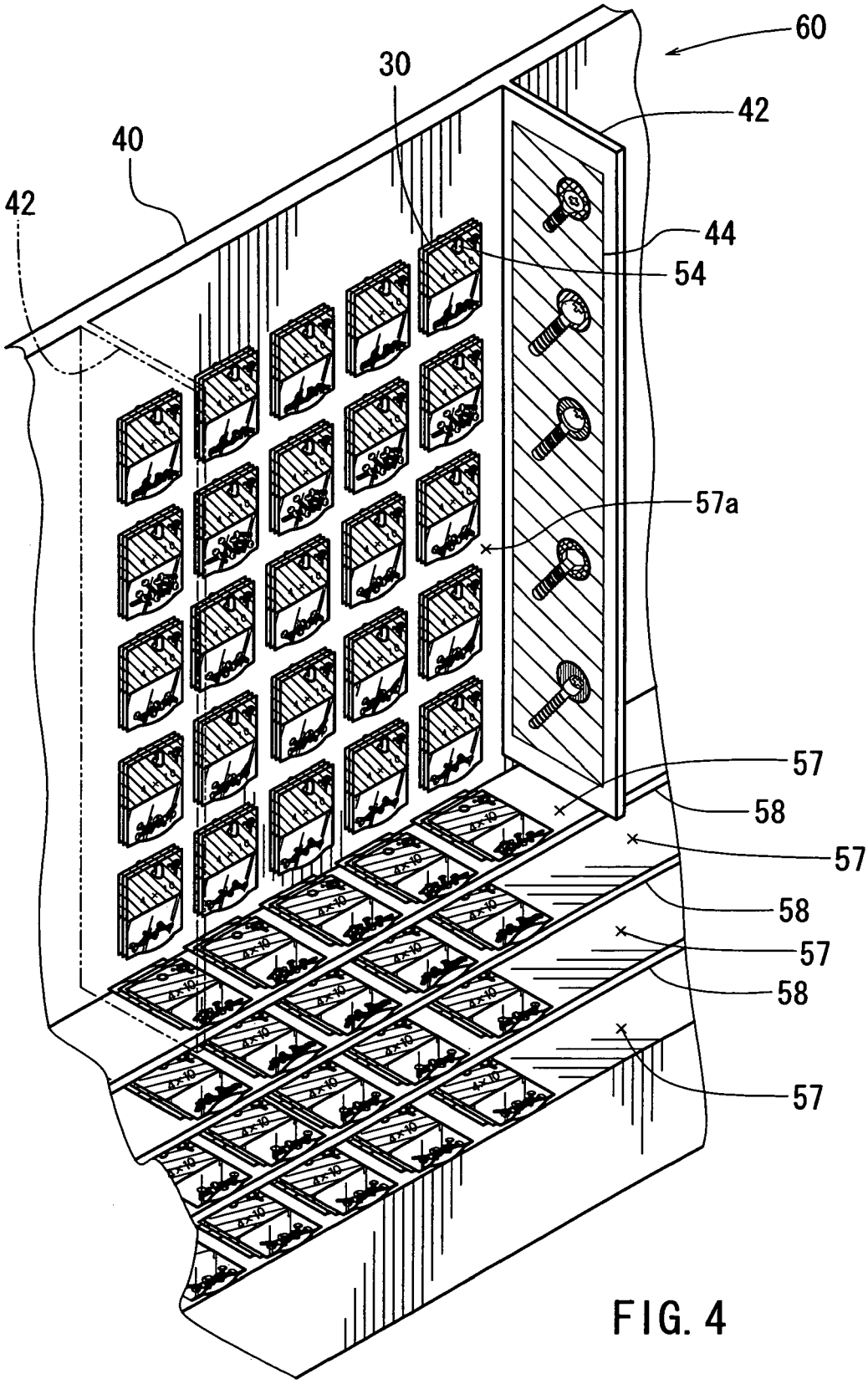
FIG. 4 is a perspective view of a representative display rack showing packaging bags displayed on the display rack.

A representative display rack 60 shown in FIG. 4 may include a flat vertical display panel 40 and a plurality of shelves 58. The shelves 58 are attached to the lower portion of the display panel 40 and define a plurality of lower display regions or lower display compartments 57. In addition, the display rack 60 may include two side display panels or generic information display panels 42 attached to the upper portion of the display panel and defining an upper compartment 57*a* there between. A plurality of hooks 54 may be mounted to the display panel 40 within the upper compartment 57*a* and may engage the through holes 17 of the packaging bags 30. As a result, the packaging bags 30 may hang down from the hooks 54 with their front portions 10 oriented toward the front side of the display rack 60. In this representative embodiment, the hooks 54 are arranged in five rows in each of the vertical and horizontal directions.

The generic information display panels 42 are elongated in the vertical direction and extend perpendicular to the front surface of the flat display panel 40. Each of the generic information display panels 42 may have a central region 44 (e.g., substantially the total region except for a peripheral portion) that is colored with a first color corresponding to the type of product, such as screws 28. In addition, a plurality of pictorial images of various types of screws may be formed on the surface of one of the generic information display panels 42 positioned on the side of the upper compartment 57*a*, as viewed in FIG. 4. In this representative embodiment, five pictorial images of different types of screws are formed on the generic information display panel 42 to correspond to the number of rows in the vertical direction of hook members 54. In addition, the head of each of the screws formed as a pictorial image is surrounded by a circular region that is colored with a different shade of color than the first color, as will be hereinafter described.

Figure 5:
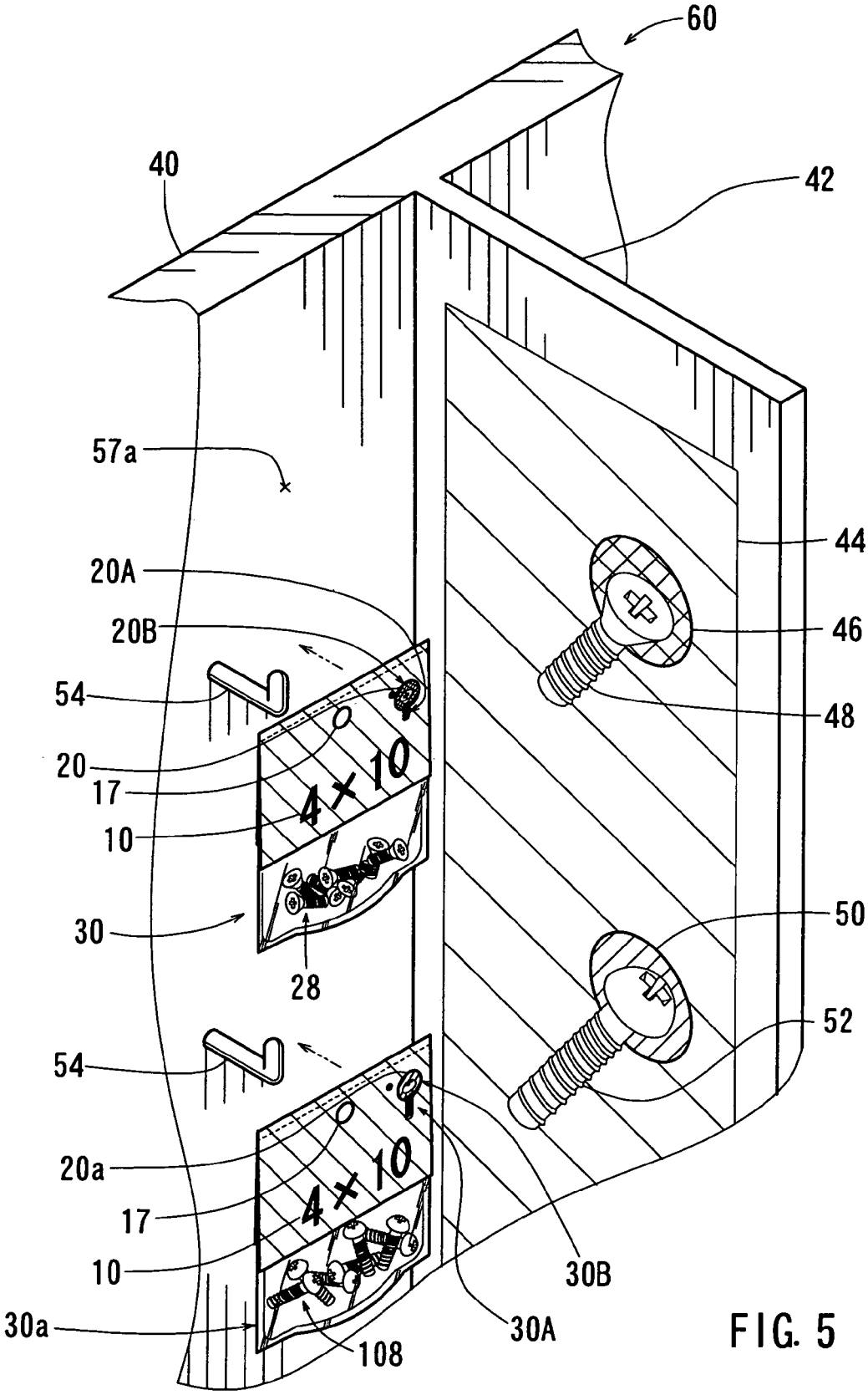
FIG. 5 is an enlarged view of a part of FIG. 4.

In this representative embodiment, as shown in FIG. 5, the pictorial images formed on the generic information display panel 42 may include a first pictorial image 48 of the screw 28 positioned at the highest position. The head of the screw 28 marked as the pictorial image 48 is surrounded by a circular region 46 (second standard information display region) that is colored with the second color corresponding to the configuration of the head of the screw 28. The pictorial images may also include a second pictorial image 52 of a screw 108 positioned on the lower side of the pictorial image 48. The screw 108 is a different configuration of screw than the screw 28. Specifically, the configuration of the head of the screw 108 is different than the configuration of the head of the screw 28. The head of the screw 108 marked as the pictorial image 52 is surrounded by a circular region 50 (second standard information display region) that is colored with a second color that is different from the shade of the first color and the shade of the second color of the circular region 46. Similarly, third to fifth pictorial images positioned below the second pictorial image 52 may be those of screws that are also different in configuration from each other and from the screws 28 and 108. In addition, the heads of the screws marked as the third to fifth pictorial images may be surrounded by circular regions (second standard information display regions) that are colored with different shades of second colors from one another, from the shade of the first color, and from the second colors of the circular regions 46 and 50.

In this representative embodiment, the highest row of packaging bags 30 hanging down from the highest row of the hooks 54 contains the screws 28. The second row from the top of packaging bags 30 (labeled with 30*a* in FIG. 5) contains the screws 108. The third to fifth rows from the top of packaging bags 30 contains the screws corresponding to the third to fifth pictorial images. In addition, the second information set 20 (labeled with 20*a* in FIG. 5) on the packaging 30*a* may be a printed image 30A of the screw 108 and a circular region 30B surrounding the head of the screw 108 in the printed image 30A. The circular region 30B is colored with a particular second color. Similarly, the second information set 20 on the packaging 30*a* of the third to fifth rows may be printed with images of the corresponding screws along with circular regions surrounding the heads of the screws in the printed images. These circular regions are also colored with different shades of particular second colors.

As described above, each of the generic information display panels 42 has the central portion 44 colored with the first color and the circular regions, such as circular regions 46 and 52, respectively colored with different shades of second colors. Therefore, a customer can obtain two different pieces of product information from the generic information display panel 42, e.g., the information with regard to the type of the fasteners and the configuration of the fasteners (specifically the configuration of the head of the screws in this representative embodiment). In particular, the customer can easily recognize the configuration of the head of the screws from the circular regions 46 (50) in conjunction with the pictorial images 48 (52) marked on the generic information display panel 42.

Representative Method of Displaying Packaging Bags

A representative method of displaying the packaging bags 30 will now be described with reference to FIG. 5. A person who displays packaging bags may initially select all of the packaging bags 30 having the display members 14 with the front portions 10 colored with the same first color as the first color shade of the central portion 44 of the generic information display panel 42. The person may then sort the packaging bags 30 into first to fifth groups to be respectively displayed at the first to fifth rows from above within the compartment 57*a*. Such a sorting operation may be performed by selecting the first group of packaging bags 30 with printed images 20A that are the same as the pictorial image 48, and that have circular regions 20B colored with the same second color as in the color of the circular region 46 of the pictorial image 48. Similarly, a second group of packaging bags 30 (30*a* in FIG. 5) may be selected with the printed images 30A that are the same as the pictorial image 52 and that have the circular regions 30B colored with the same second color as in the color of the circular region 50 of the pictorial image 52. The third to fifth groups may be selected in the same manner as the selection of the first and second groups.

After the first to fifth groups have been sorted, the person may engage the through holes 17 of the first to fifth groups of the packaging bags 30 (30*a*) respectively with the first to fifth rows of the hooks 54 such that the front portions 10 of the packaging bags 30 are positioned on the front side of the display panel 40.

As described above, the person who will display the packaging bags. 30 (30*a*) can distinguish the packaging bags 30 (30*a*) containing a particular type of fasteners having a particular configuration from those containing different types of fasteners or fasteners having different configurations. The person does this by simply comparing the color (i.e., first color) indicative of the type of fasteners (e.g., screws 28 (108)) and the color (i.e., second color) indicative of the configuration of the fasteners (e.g., the configuration of the head of the screws 28(108)) printed on the packaging bags 30 with the corresponding colors marked on the generic information display panel 42. Therefore, the packaging bags 30 (30*a*) can be reliably sorted and displayed at their respective predetermined positions within the upper compartment 57*a*. In other words, it is possible to prevent the packaging bags 30 (30*a*) from being displayed in the incorrect positions.

Although each of the pictorial images (e.g., the pictorial images 48 and 52) on the generic information display panel 42 are determined so as to correspond to one horizontal row of the hooks 54, each pictorial image may be determined to correspond to two or more horizontal rows of the hooks 54. Otherwise, a single pictorial image may be formed on the generic information display panel 42 and may correspond to all of the hooks 54. In addition, each of the pictorial images may be determined so as to correspond to hooks 54 located within a predetermined area of the flat display panel 40.

OTHER POSSIBLE EMBODIMENTS

Although the first color of the display member 14 of the packaging bag 30 has been determined to correspond to the type of fasteners, the first color of the display member 14 for the packaging bag 30 containing the particular fasteners may be the same as the first color of the display member 14 for a packaging bag 30 containing parts related to the particular fasteners. Otherwise, the circular regions 20 of the display members 14 of the packaging bags 30 containing the particular fasteners and the related parts may be colored with the same color shade, as in an alternative embodiment shown in FIGS. 6 and 7. In the alternative embodiment like members are given the same reference numerals as in the above representative embodiment.

Figure 6:
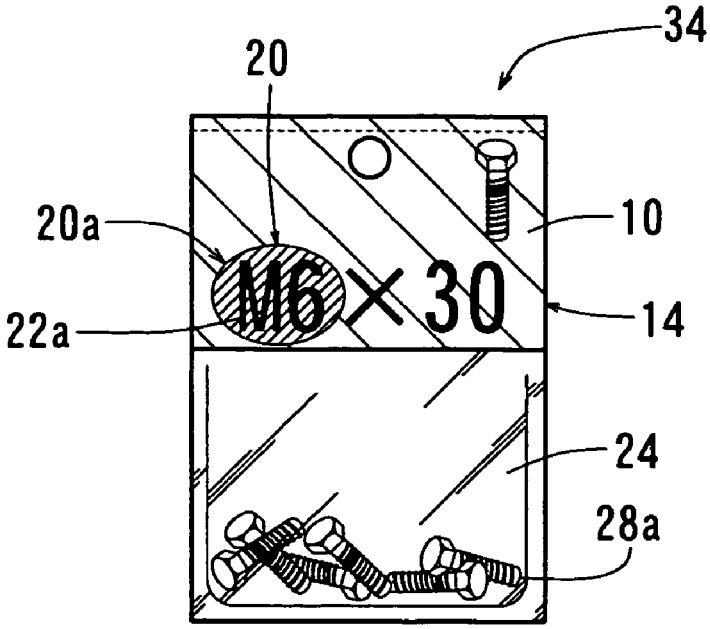
FIGS. 6 and 7 are front views of alternative packaging bags.
Figure 7:
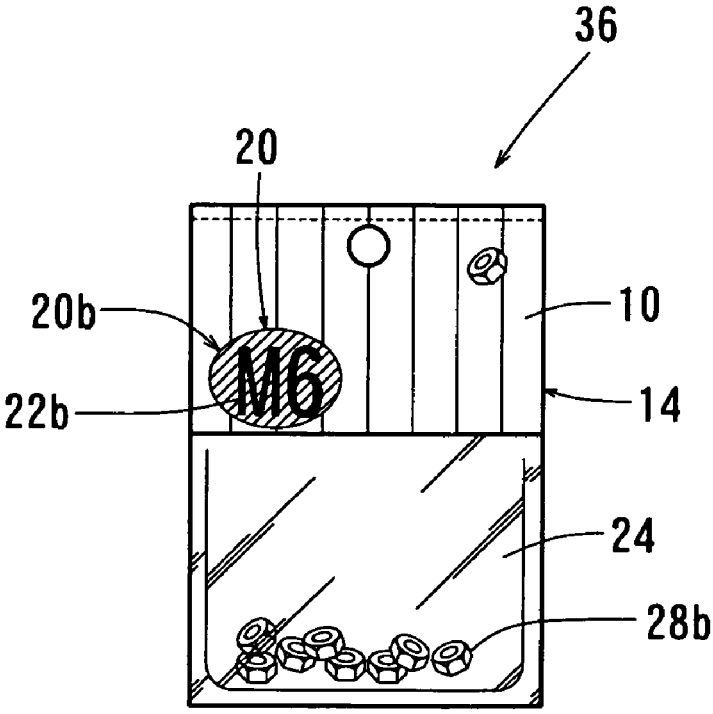
Figure 8:
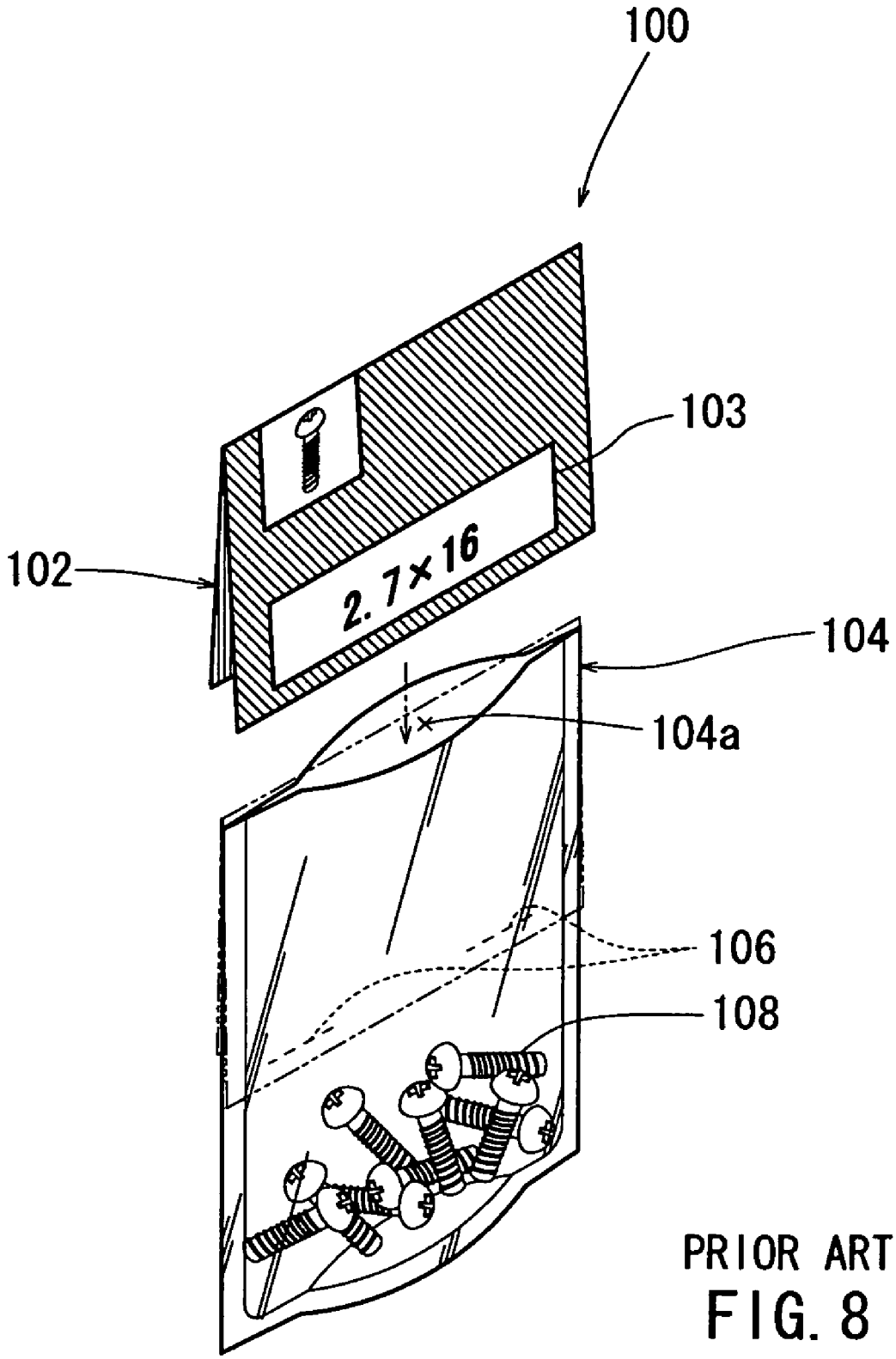
PRIOR ART FIG. 8
FIG. 8 is an exploded perspective view of a known packaging bag.

In the embodiment shown in FIGS. 6 and 7, bolts 28*a* are contained in a packaging bag 34 shown in FIG. 6. The front portion 10 (i.e., the first information display region) of the display member 14 of the packaging bag 34 is colored with a first color and includes a printed image of the bolt 28*a*, a first information set 22*a*, and a circular region 20*a* (i.e., the second information display region) colored with a second color shade. In this embodiment, the first information set 22*a* may be a reference size (e.g., "M6×30") of the bolts 28*a*. The circular region 20*a* is not positioned to surround the head of the bolt 28*a*, as shown in the printed image, but is instead positioned to surround a portion "M6" that is indicative of the nominal diameter of the metric thread. Nuts 28*b*, compatible with the bolts 28*a*, are contained in a packaging bag 36 shown in FIG. 7. The front portion 10 (i.e. the first information display region) of the display member 14 is colored with a first color, which is different from the shade of first color of the packaging bag 34. The front portion 10 also includes a printed image of the nut 28*b*, a first information set 22*b*, and a circular region 20*b*. The first information set 22*b* is a reference size (e.g., "M6") of the nut 28*b* and is the same as the "M6" portion of the circular region 20*a*. A circular region 20*b* is positioned to surround the first information set 22*b* or the "M6" and is colored with the same shade of second color as used for the second color of the circular region 20*a* of the packaging bag 34. With this arrangement, the customer can easily locate a combination of screws 28*a* and nuts 28*b*, threadably engageable with each other based upon the second color shade in conjunction with the indication "M6."

Although the tearable line 16 of the display member 14 is positioned proximate to the upper edge of the first portion 10 in the above representative embodiment, the tearable line 16 may be positioned further away from the upper edge of the first portion 10 as long as at least a part of the circular region 20 (20*a*, 20*b*) colored with a second color shade can be recognized by the customer after the removal of the rear portion 12 together with a part of the front portion 10 along the tearable line 16. It is not necessary that the front portion 10 remain substantially entirely attached to the bag body 24. Of course, the tearable line 16 may be formed along the folded line of the display member 14. It is also possible to form the tearable line 16 in the rear portion 12 as long as the bag body 24 can be opened. In addition, the tearable line 16 may not be limited to a straight line but may have a configuration of a waveform or a zigzag form, for example.

Further, the position of the through hole 17 for engagement with the hook 54 may be different between the packaging bags 30 containing different kind of fasteners or related parts. For example, the through holes 17 in the packaging bags 30 in the uppermost row shown in FIG. 5 may be positioned more upward than the through holes 17 in the packaging bags 30 (30*a*) in the second row from the above. With this arrangement, the position of the packaging bags 30 in the uppermost row may be relatively lower than the packaging bags 30*a* in the second row, when they are hanging down due to engagement of the through holes 17 with the hooks 54. Therefore, the customers can easily visually distinguish the packaging bags 30 and the packaging bags 30*a* from each other.

Furthermore, the generic information display panels 42 may also include the first information set (e.g., reference size) and third information set (e.g., price) in addition to the second information set (e.g., pictorial image). Additionally, the generic information display panels 42 may be disposed so as to extend horizontally on the upper side of the display rack 60. Alternatively, an additional generic information display panel 42 may be disposed to extend horizontally on the upper side of the display rack 60 in addition to the vertically extending generic information display panels 42. In such a case, the horizontally extending generic information display panel 42 may include different information from that displayed on the vertically extending generic information display panel 42.

In the above representative embodiment, substantially an entire surface of the front portion 10 of the packaging bag 30 is colored with a first color indicative of the type of the fastener. However, only a limited region of the front portion 10 may be colored with the first color shade. For example, only a rectangular region surrounding the first information set 22 (e.g., reference size) may be colored with the first color shade. The remaining region may be colored with any shade of color other than the first and second color shades, or may be a printed pattern. In addition, a packaging bag 30 having such a front portion 10 using a limited region or area colored with the first color shade may be used for distinguishing the packaging bags 30 having a front portion 10 substantially entirely colored with the first color shade. For example, the number of products contained within the former packaging bag 30 may be greater than or less than the number of products contained within the latter packaging bag 30. Therefore, the customer can easily distinguish the packaging bag 30 containing a large (small) number of products from the other packaging bags 30.

This invention claims:

1. A packaging bag for containing products, comprising:
a bag body having an opening; and
a display member attached to the bag body and closing the opening of the bag body;
wherein the display member has a front portion on one side of the bag body and a back portion on the other side of the bag body;
wherein the front portion of the display member has a first region colored with a first color and a second region colored with a second color,
wherein the first color and the second color are respectively indicative of a type of product and a standard of product, and
wherein the display member has a tearable line, so that the display member can be torn along the tearable line in order to enable access to the products within the bag body via the opening.

2. The packaging bag as in claim 1,
wherein the front portion further includes a first pattern and a second pattern formed thereon and respectively indicative of the type of the product and the standard of the product.

3. The packaging bag as in claim 2,
wherein the first pattern comprises characters indicative of a reference size of the product; and
wherein the second pattern comprises a pictorial image of the product.

4. The packaging bag as in claim 3, wherein the second color is indicative of the configuration of a particular part of the product.

5. The packaging bag as in claim 1, wherein the display member comprises a sheet folded to define the front portion and the back portion.

6. The packaging bag as in claim 5,
wherein the front portion and the back portion of the display member are respectively bonded to the bag body, while at least the back portion is removably bonded to the bag body; and
wherein the display member can be torn along the tearable line, so that the display member is separated into a first part on the side of the front portion and a second part on the side of the back portion,
wherein the second part can be removed from the display member by peeling off the back portion from the bag body.

7. The packaging bag as in claim 1,
wherein the front portion further includes a third pattern indicative of a price of the products.

8. The packaging bag as in claim 7, wherein the third pattern comprises at least one dot.

9. A packaging bag for containing products, comprising:
a bag body having an opening;
a display member attached to the bag body and closing the opening of the bag body;
wherein the display member has a front portion on one side of the bag body and a back portion on the other side of the bag body;
wherein the front portion includes a first region and a second region respectively colored with a first color and a second color indicative of different pieces of information related to the products;
wherein the display member has a tearable line, so that the display member can be torn along the tearable line and separated into a first part on the side of the front portion and a second part on the side of the back portion;
wherein the second part can be removed from the bag body in order to enable access to the products within the bag body via the opening.

10. The packaging bag as in claim 9,
wherein the tearable line comprises a perforated line.

11. A display rack for use in combination with the packaging bag as defined in claim 1, comprising:
a generic information display device having a third region and a fourth region respectively colored with the first color and the second color.

12. The display rack as in claim 11,
wherein the display device further comprising a printed image of the products.

13. The display rack as in claim 11,
wherein the display rack is used in combination with a plurality of the packaging bags including at least a first and a second group of packaging bags respectively containing first products and second products that are the same in type but are different in standard from each other;
wherein the display device comprises a single third region colored with the first color and at least two fourth regions colored with different second colors respectively corresponding to the first and second groups of packaging bags.

14. The display rack as in claim 13, further comprising a display panel having a plurality of hooks mounted thereon;
wherein the hooks comprise at least a first and a second group of hooks respectively corresponding to the first and second groups of packaging bags and positioned so as to respectively correspond to the fourth regions of the display device.

15. The display rack as in claim 14, wherein the display device comprises a pair of side panels extending substantially perpendicular to the display panel, so that a compartment for displaying the packaging bags is defined by the pair of side panels and the display panel.

16. A method of displaying at least one packaging bag as defined in claim 1, comprising:

providing a display rack having a generic information display device and a display panel, wherein the display device has a third region and at least one fourth region respectively colored with the first color and the corresponding at least one second color; and wherein the display panel includes at least one hook mounted thereon and positioned to correspond to the at least one fourth region of the display device;

engaging the at least one packaging bag with the at least one hook in such a manner that each of the at least one packaging bag hangs down from the hook with the front portion of the display member of the display device facing away from the display panel.

17. The method as in claim 16, further comprising:

providing a plurality of the packaging bags including at least a first group of packaging bags and a second group of packaging bags respectively containing first products and second products that are the same in type but are different in standard;

providing at least two fourth regions on the display device, wherein the at least two fourth regions are colored with different shades of second colors respectively corresponding to the at least a first group of packaging bags and a second groups of packaging bags; and providing at least a first group of hooks and a second group of hooks on the display panel, wherein the at least a first group of hooks and a second groups of hooks respectively correspond to the at least a first group of packaging bags and the second group of packaging bags; and positioning each of the at least a first group of hooks and a second group of hooks to respectively correspond to each of the at least two fourth regions of the display device; and engaging each of the at least a first group of packaging bags and a second groups of packaging bags respectively with a corresponding one of the at least a first group of hooks and a second groups of hooks with respect to the shades of second colors of each of the corresponding at least two fourth regions.

* * * * *